US005655913A

United States Patent [19]

Castaneda et al.

[11] Patent Number: 5,655,913

[45] Date of Patent: Aug. 12, 1997

[54] ELECTRICAL INTERCONNECT CONTACT

[75] Inventors: Julio C. Castaneda, Coral Springs; Christopher J. Nance, Davie; Jill C. Olkoski, Ft. Lauderdale, all of Fla.

[73] Assignee: Motorola, Inc., Schaumburg, Ill.

[21] Appl. No.: 533,802

[22] Filed: Sep. 26, 1995

[51] Int. Cl.[6] ..... H01R 9/09

[52] U.S. Cl. ..... 439/66; 439/862

[58] Field of Search ..... 439/66, 71, 752, 439/68

[56] References Cited

U.S. PATENT DOCUMENTS

| | | | |
|---|---|---|---|
| 4,354,729 | 10/1982 | Grabbe et al. | 339/258 R |
| 4,504,887 | 3/1985 | Bakermans | 361/399 |
| 4,553,192 | 11/1985 | Babuka et al. | 439/66 |
| 5,092,783 | 3/1992 | Suarez et al. | 439/71 |
| 5,213,513 | 5/1993 | Brown et al. | 439/68 |
| 5,308,252 | 5/1994 | Mroczkowski et al. | 439/66 |
| 5,403,203 | 4/1995 | Fischl et al. | 439/500 |
| 5,421,745 | 6/1995 | Aksoy et al. | 439/626 |

*Primary Examiner*—Neil Abrams
*Assistant Examiner*—Eugene G. Byrd
*Attorney, Agent, or Firm*—Barbara R. Doutre

[57] ABSTRACT

Metallized contacts (102, 104) electrically interconnect two substrates (202, 204). Each metallized contact (102, 104) includes a stationary base member (106, 130) and a compressible member (112, 128) extending from the stationary base member. At least one retaining wall (118, 124) is used to retain each of the compressible members (112, 128) to prevent shorting between each of the metallized contacts (102, 104).

9 Claims, 2 Drawing Sheets

ELECTRICAL INTERCONNECT CONTACT

TECHNICAL FIELD

This invention relates in general to electrical interconnects and more specifically to electrical contacts.

BACKGROUND

Communication products, such as portable radios, often use two or more electronic circuit boards to provide various communication functions. It is not uncommon for radios to have separate radio frequency (RF), controller, and keypad boards interconnected through pin/socket or flex type connectors. One of the most cost effective interconnect methods employs metallized contacts formed from sheet-metal and coupled to a lead frame. The metallized contacts are machine placed and reflowed onto a printed circuit board (PCB) with the lead frame still attached. Once the reflow process is completed the lead frame is broken away to provide an array of individual adjacent contacts to mate to corresponding conductive pads on an opposing PCB. One drawback to current day lead frame contacts is that when a radio is dropped, the adjacent contacts have the potential of shorting to each other. One way to address this problem is to include an insulator frame around each metallized contact. Typically, the insulator frame is formed of a heat resistive plastic that frames the sides of the individual metallized contacts. It would be advantageous to have a series of metallized contacts which could be mounted in close proximity to each other without the use of an insulator.

With current design trends focusing on smaller communication products, it follows that space and size constraints are continuously being challenged. It is critical that interfaces between circuit boards take up as little room as possible while still providing reliable interconnects.

Accordingly, there is a need for an improved metallized contact that provides a reliable electrical interconnect which can be mounted in close proximity to similar contacts without the use of an insulator. A metallized contact that would lend itself to the lead frame format would also be a benefit in helping to keep manufacturing costs to a minimum.

DETAILED DESCRIPTION OF THE PREFERRED EMBODIMENT

Figure 1:
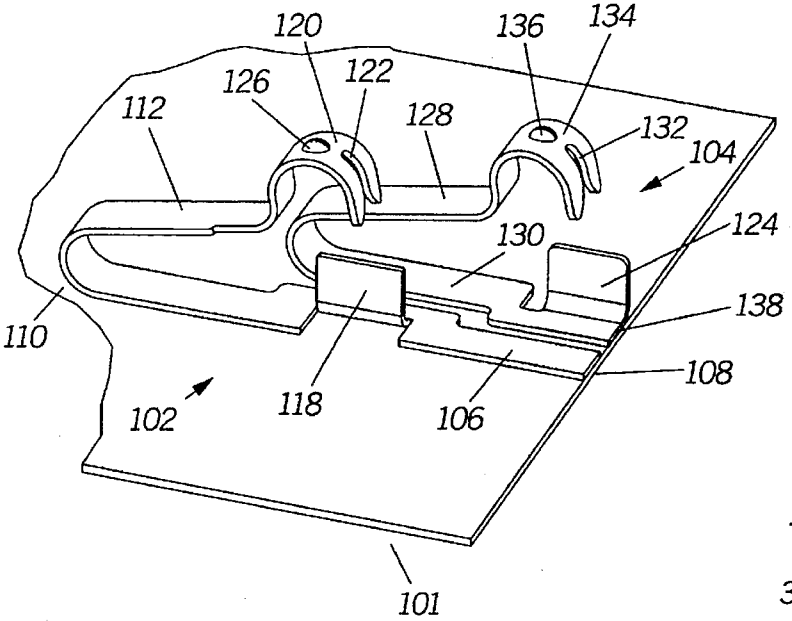
FIG. 1 is an isometric view of two a metallized contacts in a decorepressed state in accordance with the present invention.

Referring to FIG. 1 of the accompanying drawings, there is shown an isometric view of a first metallized contact 102 and a second metallized contact 104 in accordance with the preferred embodiment of the present invention. It is to be appreciated that the inventive concept resides in each individual metallized contact for the purpose of preventing multiple contacts from shorting to each other when such contacts are mounted in close proximity to each other in a tightly pitched array. Metallized contacts 102, 104 are preferably gold plated contacts, however other conductive metals can be used as well Metallized contact 102 will be described initially, with a description of metallized contact 104 to follow suit.

Metallized contact 102 is an integral contact which includes a stationary base member 106 having first and second ends 108, 110 and a compressible member 112 extending from the second end of the stationary base member and forming an angle therebetween. Stationary base member 106 is mounted onto a circuit carrying substrate 101, preferably using conventional soldering and reflow techniques. Compressible member 112 is a spring-like member which can be compressed and decompressed so as to vary the angle between the stationary base member 106 and the compressible member. In accordance with the preferred embodiment of the invention, stationary base member 106 includes a tab 118 formed within the stationary base member and folded or bent so as to be substantially perpendicular to the stationary base member and the plane of the circuit carrying substrate 101. Compressible member 112 includes an upper end which is preferably formed into a protruding semicircular extension or hook having a rounded top surface area providing what will be referred to as a wiping contact 120. In accordance with the preferred embodiment of the invention, wiping contact 120 of compressible member 112 includes a notch or forked aperture 122 substantially aligned with tab 118. In accordance with the present invention, metallized contact 102 provides a compressed state and a decompressed state with the decompressed state being shown in FIG. 1, and the compressed state being shown in FIG. 2. In accordance with the preferred embodiment, tab 118 receives notch 122 to restrict horizontal (side-to-side) movement of the compressible member 112 in the plane parallel to the substrate 101 and perpendicular to the tab 118 when the metallized contact 102 is in the compressed state. A protruding bump or nub 126 is preferably formed on the top surface of wiping contact 120 to provide further contact reliability as will be described in FIG. 2.

Still referring to FIG. 1, second metallized contact 104 is substantially similar to first metallized contact 102 in the manner in which it restricts horizontal (side-to-side) movement of its'respective compressible member 128 when metallized contact 104 is in the compressed state. Compressible member 128 extends from its respective stationary base member 130 forming an angle therebetween which is substantially equivalent to the angle formed in adjacent contact 102. Compressible member 128 also includes a wiping contact 134 having a notch 132 and a hub 136. Stationary base member 130 includes a tab 124 substantially similar to tab 118 but preferably formed towards a first end 138 of the stationary base member. Notch 132 of wiping contact 134 is received by tab 124 when the second metallized contact 104 is in the compressed state. In the preferred embodiment of the invention, tab 124 is preferably bent from the right side of stationary base member 130 while tab 118 is preferably bent from the left side of stationary base member 106 so as to form substantially parallel non-opposing tabs. The first ends 108, 138 of stationary base members 106, 130 can be aligned to form adjacent parallel contacts in close proximity to each other having overlapping compressible members 112, 128 which have a reduced potential of shorting to each other when in the compressed state. This configuration also allows for more wiping contacts to be provided over a small surface area without the need for any insulators in between the metallized contacts.

The metallized contacts 102, 104 described by the preferred embodiment of the invention, utilize tabs 118, 124 to act as retaining walls for their respective compressible members. Movement of the compressible members 112, 128 can thus be restricted by including a retaining wall, preferably within each of the stationary base members, to prevent shorting between the metallized contacts.

Figure 2:
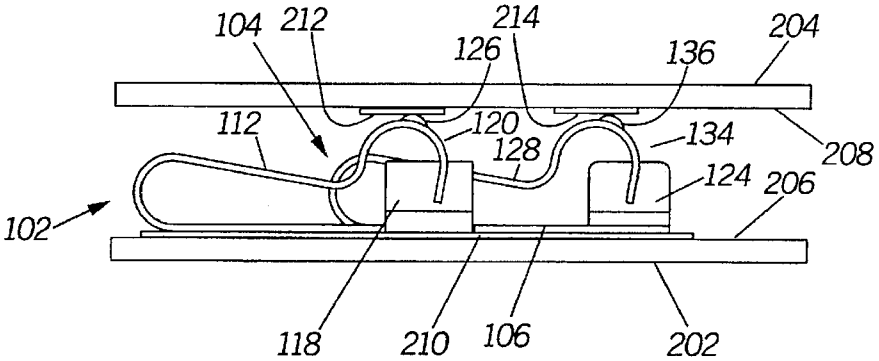
FIG. 2 is a side view of the metallized contacts of FIG. 1 in a compressed state.

Referring now to FIG. 2, there is shown a side view of metallized contacts 102, 104 in a compressed state in accordance with the preferred embodiment of the present invention. Metallized contacts 102 and 104 are preferably compressed between first and second circuit carrying substrates 202, 204, such as printed circuit boards, having first and second inner surfaces 206, 208 respectively. First metallized contact 102 is secured to first inner surface 206 by means of solder on a contact pad 210. Second metallized contact 104 is similarly soldered to a similar contact pad (not shown). The second substrate 204 is secured by conventional means such that its'inner surface 208 is pressed down on top of the metallized contacts 102, 104. A first terminal pad 212 is biased against hub 126 and wiping contact 120, thereby forcing the compressible member 112 resiliently towards the stationary base member 106. Metallized contact 104 is compressed in a similar fashion via a second terminal pad 214.

As the compressible member 112 of first metallized contact 102 is pressed towards the stationery base member 106, the angle formed between the compressible member and the stationary base member decreases as a function of contact pressure. This change in angle provides the "wiping" action of the metallized contact by lateral movement of the wiping contact 120. In accordance with the preferred embodiment of the invention, notched portion 122 of wiping contact 120 is received by tab 118 when metallized contact 102 is in the compressed state. Second metallized contact 104 is compressed in a similar fashion between terminal pad 214 and its respective contact pad. Low impedance electrical contact is thus achieved between the contact pad 210 and the first terminal pad 212 and also between the not shown contact pad and second terminal pad 214.

Any contaminate ion or debris that may possibly form on the terminal pads 212, 214 over time will be disrupted by nubs 126, 136 being wiped over their respective terminal pads via wiping contact 120, 134. While the wiping contact preferably includes nubs 126, 136 one skilled in the art appreciates that if conditions exist that limit the contamination exposure of the terminal pads 212, 214 the wiping contacts 120, 134 are sufficient to provide excellent electrical contact between the two substrates 202, 204.

In accordance with the present invention, horizontal (side-to-side) movement of the compressible member 112 is restricted about the sides of tab 118 when the metallized contact 102 is in the compressed state. Any horizontal movement of the compressible member of metallized contact 104 is similarly restricted by tab 124. This restriction of horizontal movement helps prevent compressible members 112, 128 of adjacent contacts 102, 104 from shorting to each other while still maintaining a tight pitch between the contacts. Vertical (up-and down) movement of the compressible member 112 is restricted by the first and second circuit carrying substrates 202, 204 in the compressed state.

Thus, there has been provided a metallized contact that provides both restriction of horizontal movement and vertical movement when in a compressed state.

Figure 3:
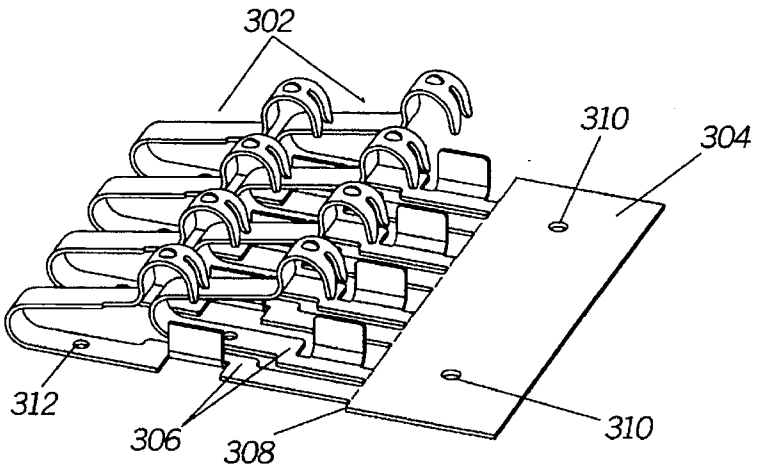
FIG. 3 is an isometric view of an array of metallized contacts integrally coupled to a lead frame in accordance with the present invention.

FIG. 3 is an isometric view of an array of metallized contacts integrally retained by a lead frame in accordance with the present invention. The array of metallized contacts comprises a plurality of adjacent metallized contacts 302 which are substantially similar to those shown and described in FIG. 1. The plurality of metallized contacts 302 can be cut and formed from sheet metal into patterns that provide for staggered rows of parallel yet partially overlapping contacts as illustrated. As part of the metallized contact manufacturing design, the lead frame 304 is scored along the first ends of stationary base members 306 (shown as scored line 308). This lead frame 304 provides a snap-off alignment bar, which is removed after the metallized contacts 302 are soldered to a first surface, such as the inner surface 206 of first circuit carrying substrate 202 seen in FIG. 2. The snap off alignment bar preferably includes holes or guides 310 used in the manufacturing step and repeat process of the sheet metal. It may also be desirable to include holes 312 within a portion of the stationary base members 306 to aid in the reflow process of the metallized contacts. After the alignment and soldering of stationary base members 306, the lead frame 304 is bent and snapped off along score line 308, to provide individual contacts with which to interface to a second substrate, such as the second circuit carrying substrate 204 of FIG. 2.

Figure 5:
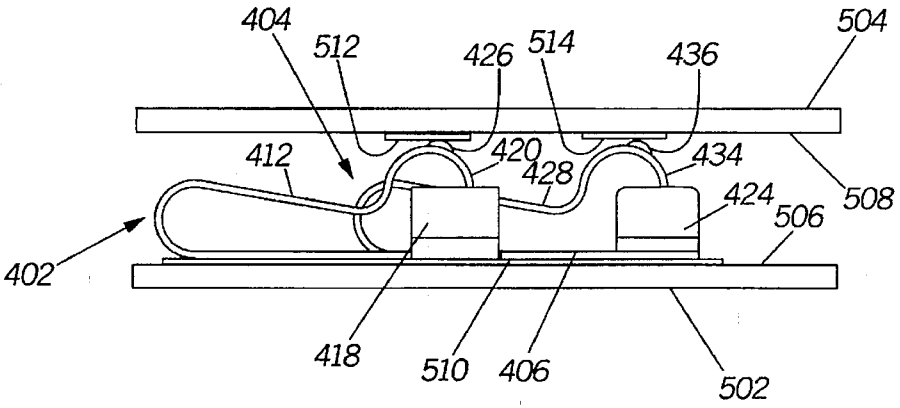
FIG. 5 is a side view of the metallized contacts of FIG. 4 in a compressed state.
Figure 4:
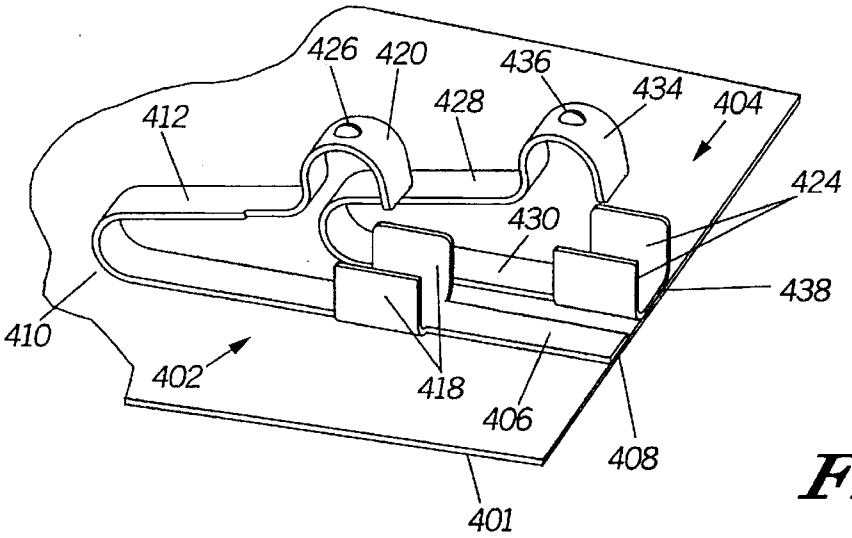
FIG. 4 is an isometric view of two metallized contacts in a decompressed state in an alternative embodiment of the present invention.
Figure 6:
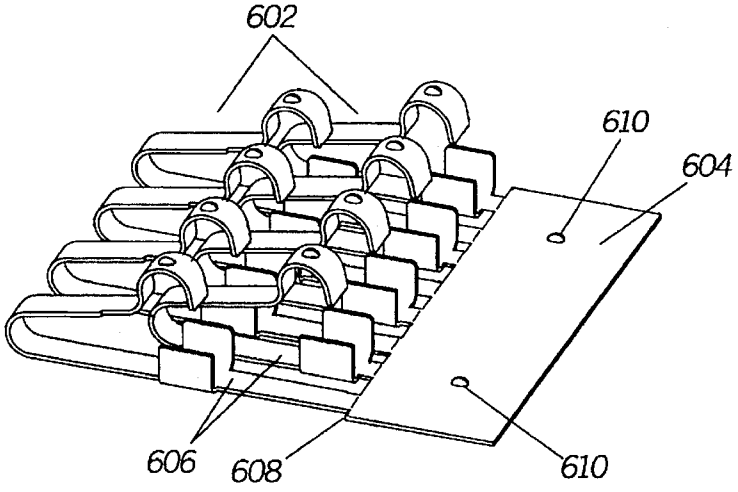
FIG. 6 is an isometric view of an array of metallized contacts integrally coupled to a lead frame in accordance with the alternative embodiment of the present invention.

FIGS. 4, 5 and 6 show an alternative embodiment of the present invention. In keeping with the spirit and scope of the present invention, this alternative embodiment provides a metallized contact with limited horizontal (side-to-side) movement. When a plurality of such contacts are mounted in a tightly pitched array to make electrical interconnections between circuit carrying substrates, both horizontal movement between the contacts and vertical movement of the contacts between the substrates are restricted.

Referring now to FIG. 4, there is shown a first metallized contact 402 and a second metallized contact 404 in accordance with the alternative embodiment of the invention. For simplicity, metallized contact 402 will be described initially, with a description of metallized contact 404 to follow suit. Metallized contact 402 is an integral contact which includes a stationary base member 406 having first and second ends 408, 410 and a compressible member 412 extending from the second end of the stationary base member and forming an angle therebetween. Stationary base member 406 is mounted onto a circuit carrying substrate 401, preferably using conventional soldering and reflow techniques. Compressible member 412 is a spring-like member which can be compressed and decompressed so as to vary the angle between the stationary base member 406 and the compressible member. Compressible member 412 includes an upper end which is preferably formed into a protruding semicircular extension or hook having a rounded top surface area providing what will be referred to as a wiping contact 420.

In accordance with the alternative embodiment of the invention, stationary base member 406 includes sidewalls 418 folded or bent so as to be substantially perpendicular to the stationary base member and the substrate 401. Sidewalls 418 are formed so as to provide substantially parallel and opposing walls with which to receive a portion of wiping contact 420 when compressible member 412 is pressed towards the stationary base member 406. Metallized contact 402 provides a compressed state and a decompressed state with the decompressed state being shown in FIG. 4 and the compressed state being shown in FIG. 5. In accordance with the alternative embodiment, sidewalls 418 restrict horizontal (side-to-side) movement of the compressible member 412 in the plane parallel to the substrate 401 and perpendicular to the sidewalls 418 when the metallized contact 402 is in the compressed state. A protruding bump or hub 426 is preferably formed on the top surface of wiping contact 420 to provide further contact reliability as will be described in FIG. 5.

Still referring to FIG. 4, second metallized contact 404 is substantially similar to first metallized contact 402 in the manner in which it restricts horizontal (side-to-side) movement of its'respective compressible member 428. By varying the location of the sidewalls along side edges of the stationery base member a variety of contact configurations can be formed. Compressible member 428 extends from its respective stationary base member 430 forming an angle therebetween which is substantially equivalent to the angle formed in adjacent contact 402. Stationary base member 430 includes sidewalls 424 which are substantially similar to sidewalls 418 but are located towards the first end 438 of stationary base member 430. Compressible member 428 also includes a wiping contact 434 having hub 436, similar to nub 426. When a plurality of interconnects are required over a small surface area, a plurality of metallized contacts configured in the manner of metallized contacts 402, 404 helps maximize the number of contacts per area.

The first ends 408, 438 of stationary base members 406, 430 can be aligned to form adjacent parallel contacts in close proximity to each other having overlapping compressible members 412, 428 which have a reduced potential of shorting to each other when in the compressed state. This alternative configuration allows for a plurality of wiping contacts to be provided over a small surface area without the need for insulators in between the metallized contacts.

Referring now to FIG. 5, there is shown a side view of metallized contacts 402, 404 in a compressed state in accordance with the alternative embodiment of the invention. Metallized contacts 402 and 404 are preferably compressed between first and second circuit carrying substrates 502, 504 having first and second inner surfaces 506, 508 respectively. The stationary base member 406 of first metallized contact 402 is secured to first inner surface 506 by means of solder on a contact pad 510. Second metallized contact 404 is similarly secured to a contact pad (not shown) on first surface inner 506. The second circuit carrying substrate 504 is secured by conventional means such that its'inner surface 508 is pressed down on top of the metallized contacts 402, 404. A first terminal pad 512 is biased against hub 426 and wiping contact 420, thereby forcing the compressible member 412 resiliently towards the stationary base member 406. Metallized contact 404 is similarly compressed via a second terminal pad 514.

As the compressible members 412, 428 are pressed towards their respective stationery base members 406, 430 the angle formed between the compressible members and the stationary base members decreases as a function of contact pressure. This change in angle provides the "wiping" action of the metallized contact by lateral movement of the wiping contacts 420, 434. Sidewalls 418, 424 receive end portions of wiping contacts 420, 434 respectively while hubs 426, 436 provide contact to terminal pads 512, 514 respectively. Sidewalls 418, 424 thus restrict the side-to-side movement of compressible members 412, 428. Low impedance and reliable electrical contact is thus achieved between the contact pads and terminal pads of substrates 502, 504.

Any contaminate ion or debris that may possibly form on the terminal pads 512, 514 over time will be disrupted by hubs 426, 436 being wiped over their respective terminal pads via wiping contacts 420, 434. While the wiping contacts 420, 434 preferably include hubs 426, 436, one skilled in the art appreciates that if conditions exist that limit the contamination exposure of the terminal pads 512, 514, the top surfaces of wiping contacts 420, 434 are sufficient to provide reliable, low impedance electrical contact between the two substrates 502, 504.

In accordance with this alternative embodiment, horizontal (side-to-side) movement of the compressible members 412, 428 is restricted within their respective sidewalls 418, 424 when in the compressed state. This restriction of horizontal movement helps prevent compressible members 412, 428 of adjacent contacts 402, 404 from potentially shorting to each other while still allowing maintaining tight proximity between contacts. Vertical (up and down) movement of the compressible members 412, 428 is thus restricted by the first and second circuit carrying substrates 502, 504. Thus, there has been provided a metallized contact that provides both restriction of horizontal movement and vertical movement when in a compressed state.

FIG. 6 is an isometric view of an array of metallized contacts integrally retained by a lead frame in accordance with the alternative embodiment of the invention. The array of metallized contacts comprises a plurality of adjacent metallized contacts 602, similar to those shown and described in FIG. 4. The plurality of metallized contacts 602 can be cut and formed from sheet metal into patterns that provide for staggered rows of parallel yet partially overlapping contacts as illustrated. As part of the metallized contact manufacturing design, the lead frame 604 is scored along the stationary base members 606 (shown as scored line 608). The lead frame 604 provides a snap-off alignment bar, which is removed after the metallized contacts 602 are soldered to a first surface, such as the first inner surface 506 of the first circuit carrying substrate 502 seen in FIG. 5. The snap off alignment bar preferably includes holes or guides 610 used in the manufacturing step and repeat process of the sheet metal. After the alignment and soldering of stationary base members 606, the lead frame 604 is bent and snapped off along scored line 608, to provide individual contacts with which to interface to a second substrate, such as second substrate 504 of FIG. 5.

The metallized contacts 102, 104, and 402, 404, described by the present invention, utilize either tabs or sidewalls to act as retaining walls for their respective compressible members. Movement of the compressible members can thus be restricted by including at least one retaining wall, preferably within each of the stationary base members, to prevent shorting between the metallized contacts.

Accordingly, there has been provided a metallized contact that restricts horizontal and vertical movement of its compressible member when in a compressed state. A plurality of such contacts can be used in dose proximity to each other to provide reliable electrical interconnects between substrates without the use of an insulator between adjacent contacts. Electrical and mechanical integrity of products having multiple circuit carrying substrates can be improved by employing the metallized contacts described by the invention. When such products are dropped or submitted to a force on a side parallel to the substrates and perpendicular to the tabs or sidewalls of the compressible members, the potential for shorting between contacts is greatly reduced.

While the preferred embodiments of the invention have been illustrated and described, it will be dear that the invention is not so limited. Numerous modifications, changes, variations, substitutions, and equivalents will occur to those skilled in the art without departing from the spirit and scope of the present invention as defined by the appended claims.

What is claimed is:

1. A plurality of metallized contacts for electrically interconnecting first and second substrates, each of the plurality of metallized contacts comprising:

a stationary base member coupled to the first substrate;

a compressible member extending from the stationary base member and contacting the second substrate;

a tab extending from the stationary base member; and the compressible member including a notched opening disposed about the tab to prevent shorting between each of the plurality of metallized contacts.

2. A metallized contact for electrically interconnecting first and second circuit carrying substrates, said metallized contact including:

a stationary base member soldered to said first circuit carrying substrate;

a compressible member extending from said stationary base member and contacting said second circuit carrying substrate, said stationary base member including a means for restricting horizontal movement of said compressible member while said second circuit carrying substrate restricts vertical movement of said compressible member; and wherein said means for restricting horizontal movement of said compressible member includes a tab extending from said stationary base member and a notched opening formed within said compressible member disposed about said tab.

3. A metallized contact as described in claim 2, wherein said compressible member includes a nub making contact with the second circuit carrying substrate.

4. A metallized contact, comprising:

a stationary base member;

a compressible member extending from the stationary base member and including a notched portion, said compressible member having compressed and decompressed states;

a tab extending from said stationary base member and substantially aligned with said notched portion of said compressible member; and said notched portion receiving said tab in the compressed state, said notched portion restricting horizontal movement of the compressible member in the compressed state.

5. A metallized contact for interconnecting first and second circuit carrying substrates, said metallized contact comprising:

a stationary base member including a tab extending therefrom, said stationary base member mechanically and electrically coupled to said first circuit carrying substrate;

a compressible member extending from said stationary base member and including a notched opening disposed about said tab, said compressible member forming an electrical contact with said second circuit carrying substrate; and said tab restricting horizontal movement of said compressible member in a plane parallel to the first and second circuit carrying substrates and perpendicular to said tab while said second circuit carrying substrate restricts vertical movement of the compressible member in a plane perpendicular to the first and second circuit carrying substrates.

6. A metallized contact for interconnecting first and second printed circuit boards, the metallized contact comprising:

a stationary base member;

a compressible member extending from and substantially aligned with the stationary base member, the compressible member having compressed and decompressed states; and a single retaining wall extending from the stationary base member, the single retaining wall restricting horizontal movement of the compressible member in a plane parallel to the first and second printed circuit boards and perpendicular to the at least one retaining wall while the second circuit carrying substrate restricts vertical movement of the compressible member in a plane perpendicular to the first and second circuit carrying substrates in the compressed state.

7. A metallized contact as described in claim 6, wherein the compressible member includes a notched opening, and the single retaining wall comprises a tab extending from said stationary base member, the tab receiving the notched opening when the compressible member is in the compressed state.

8. A plurality of substantially parallel metallized contacts for electrically interconnecting first and second circuit carrying substrates, each of said plurality of metallized contacts comprising:

a stationary base member including a tab extending therefrom, said stationary base member soldered to the first circuit carrying substrate;

a compressible member extending from said stationary base member and including a wiping contact having a notched opening, said wiping contact contacting said second circuit carrying substrate while said tab receives said notched opening; and said notched opening restricting horizontal movement of said compressible member in a plane parallel to said first and second circuit carrying substrates and perpendicular to said tab.

9. A plurality of substantially parallel metallized contacts as described in claim 8, wherein the wiping contacts are staggered and the compressible members are partially overlapping.

* * * * *